US012201254B2

(12) United States Patent
Wolowicz et al.

(10) Patent No.: US 12,201,254 B2
(45) Date of Patent: Jan. 21, 2025

(54) DISHWASHER WITH LIQUID STORAGE TANK

(71) Applicant: WHIRLPOOL CORPORATION, Benton Harbor, MI (US)

(72) Inventors: Mateusz Michal Wolowicz, Wroclaw (PL); Rafal Rejdych, Szczodre (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/541,443

(22) Filed: Dec. 3, 2021

(65) Prior Publication Data

US 2023/0172421 A1 Jun. 8, 2023

(51) Int. Cl.
*A47L 15/42* (2006.01)
*A47L 15/00* (2006.01)

(52) U.S. Cl.
CPC ..... *A47L 15/4221* (2013.01); *A47L 15/0005* (2013.01); *A47L 15/0007* (2013.01); *A47L 15/0013* (2013.01); *A47L 15/4225* (2013.01); *A47L 15/4229* (2013.01)

(58) Field of Classification Search
CPC .. A47L 15/4221; A47L 15/0005; A47L 15/00; A47L 15/0013; A47L 15/4225; A47L 15/4229
See application file for complete search history.

(56) References Cited

U.S. PATENT DOCUMENTS

| | | | | |
|---|---|---|---|---|
| 9,516,989 | B2 | 12/2016 | Buser et al. | |
| 10,638,912 | B1 * | 5/2020 | Visin | A47L 15/507 |
| 11,006,813 | B2 | 5/2021 | Naik et al. | |
| 2010/0229900 | A1 | 9/2010 | Rosenbauer | |
| 2011/0114140 | A1 * | 5/2011 | Heisele | A47L 15/0015 68/12.01 |
| 2012/0204912 | A1 | 8/2012 | Druecker et al. | |
| 2014/0060597 | A1 * | 3/2014 | Welch | A47L 15/4246 134/107 |
| 2014/0224286 | A1 | 8/2014 | Lee et al. | |
| 2014/0261576 | A1 | 9/2014 | Lee et al. | |
| 2018/0325349 | A1 * | 11/2018 | Cho | A47L 15/4223 |
| 2019/0290097 | A1 | 9/2019 | Naik et al. | |
| 2020/0121157 | A1 | 4/2020 | Vallejo et al. | |

FOREIGN PATENT DOCUMENTS

| | | | |
|---|---|---|---|
| CN | 111345761 | A | 6/2020 |
| DE | 102008055018 | A1 | 6/2010 |
| EP | 2570068 | A1 | 3/2013 |
| EP | 3146882 | A1 | 3/2017 |
| IT | T0202110942 | A1 | 4/2013 |
| JP | 2012024117 | A | 2/2012 |

OTHER PUBLICATIONS

Extended European search report corresponding to EP Application No. 22210702.1.

* cited by examiner

*Primary Examiner* — Mikhail Kornakov
*Assistant Examiner* — Emily H Yasharpour
(74) *Attorney, Agent, or Firm* — McGarry Bair PC

(57) ABSTRACT

A dishwasher with a tub that defines a treatment chamber, a sump fluidly connected to the tub, sprayers within the treatment chamber, a drain pump fluidly connecting the sump to a discharge pipe, a water tank fluidly connected to the sump with a controllable valve, a softener, and a diverter valve fluidly connecting the sump and the sprayers.

20 Claims, 8 Drawing Sheets

DISHWASHER WITH LIQUID STORAGE TANK

BACKGROUND

Dishwashers are known to have tanks for added water storage capability in order to save clean rinse water for later use. Such tanks provide for additional functionality in water use and re-use. Typically, different tanks are used for fresh water and reused water, with both tanks being plumbed to the dishwasher sump for distribution with the recirculation pump.

BRIEF DESCRIPTION

In one aspect, the disclosure relates to a dishwasher for treating dishes according to a cycle of operation, the dishwasher comprising a tub at least partially defining a treating chamber; a sump fluidly connected to the tub; at least a first sprayer and a second sprayer emitting liquid into the treating chamber; a liquid recirculation circuit having a first branch fluidly coupled to the first sprayer and a second branch fluidly coupled to the second sprayer; a diverter valve selectively fluidly coupled to the first branch or the second branch; a wash pump fluidly coupled the sump to the diverter valve; a water supply system comprising a tank, a household water supply line fluidly coupled to the tank, a sump supply line fluidly coupling the tank to the sump, and a diverter supply line fluidly coupling the tank to the diverter valve.

In another aspect, the disclosure relates to a cycle of operation for a dishwasher, comprising a pre-wash phase comprising supplying a charge of liquid from a tank through a diverter valve to the sump and recharging the tank with fresh water from a household water supply; a main wash phase, following the pre-wash phase, comprising supplying a second charge of liquid from the tank, through the diverter valve, to the sump and recharging the tank with fresh water from the household water supply; a rinse phase, following the main wash phase, comprising supplying a charge of liquid from the tank, through the diverter valve, to the sump to form a charge of rinse liquid; a drying phase, following the rinse phase, comprising reducing the humidity within a treating chamber of the dishwasher; and supplying the charge of rinse liquid to the tank through the diverter valve.

DETAILED DESCRIPTION

Figure 1:
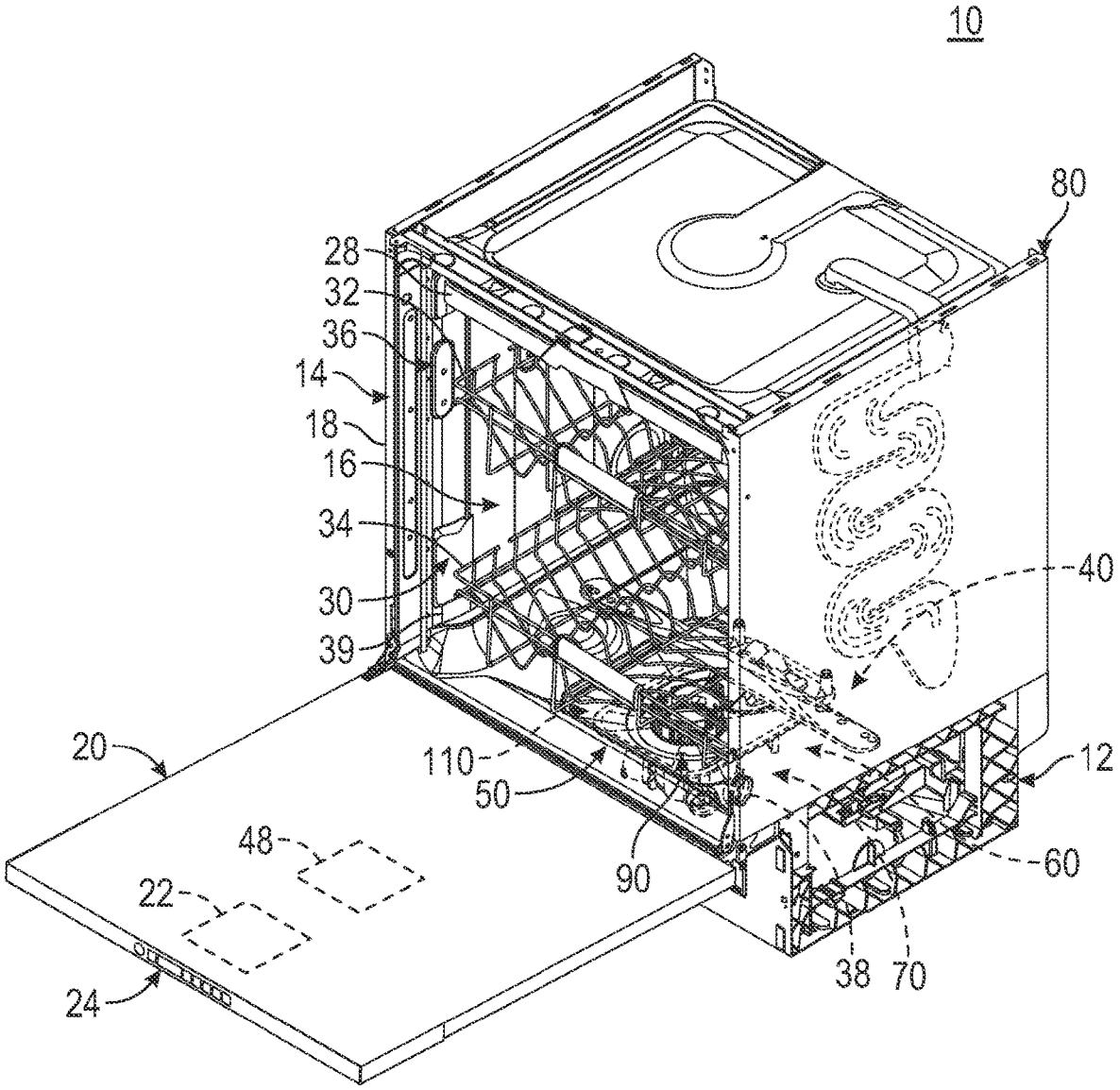
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported an open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 110. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slideably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
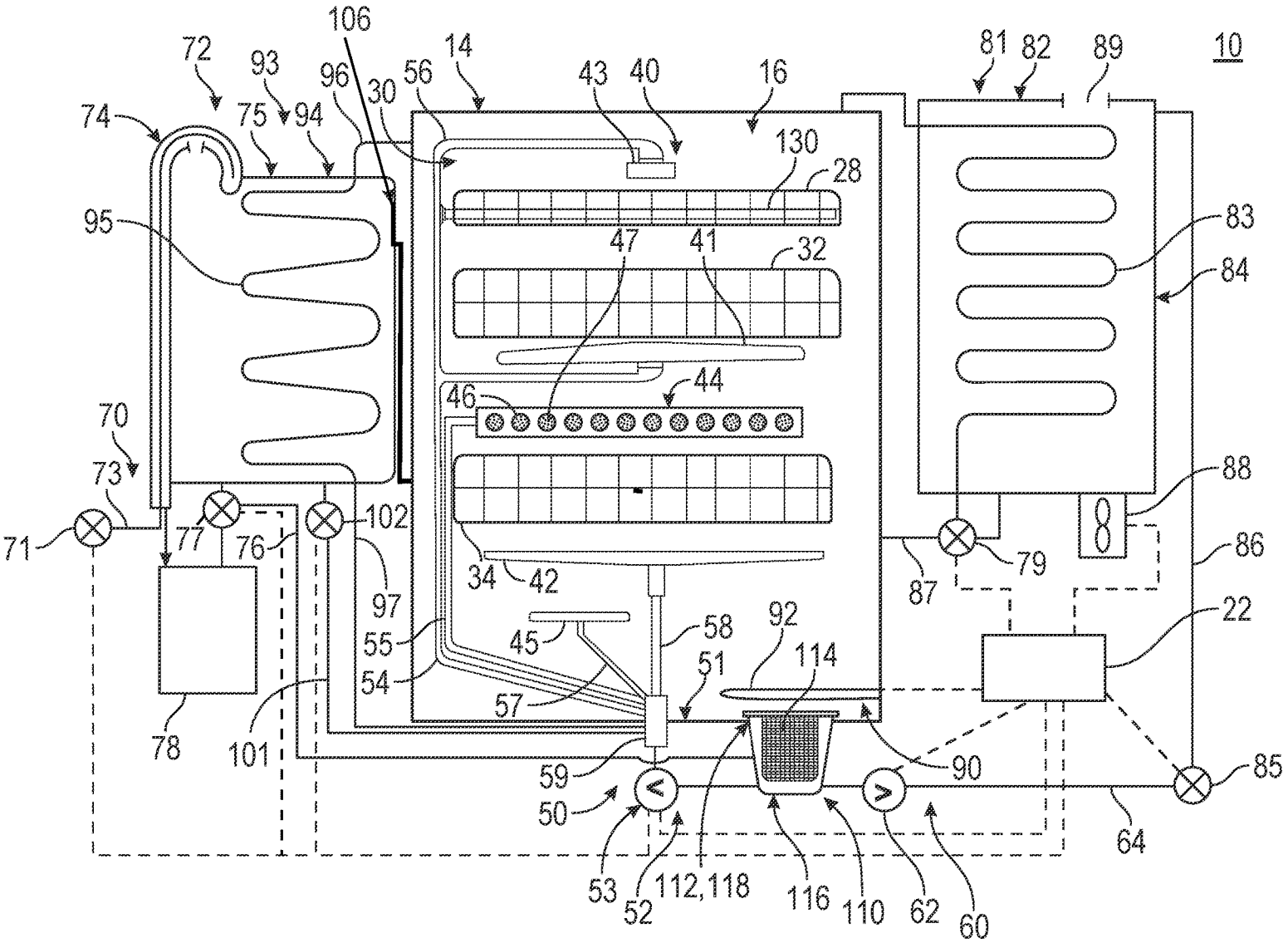
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, the sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 28-44 to the recirculation pump 53. A diverter valve 59 can be selectively moveable between positions that fluidly couple each of the conduits 54-58 to the recirculation pump 53. While each sprayer 28-44 is illustrated as having a corresponding dedicated supply conduit 54-58 one or more subsets, comprising multiple sprayers from the total group of sprayers 28-44, can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The diverter valve 59, while illustrated as a single valve, can be implemented with multiple valves and can be selectively moveable between positions. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A household water supply system 70 is provided for supplying fresh water to the dishwasher 10 from a household water supply via a household water valve 71. The water supply system 70 includes a water supply unit 72 having a water supply conduit 73 with a siphon break 74. The water supply conduit 73 is uni-directional. While the water supply conduit 73 can be directly fluidly coupled to the tub 14 or any other portion of the dishwasher 10, the water supply conduit is shown fluidly coupled to a refill tank or a supply tank 75, which can store the supplied water prior to use. The supply tank 75 is fluidly coupled to the sump 51 by a supply line 76, which can include a controllable valve 77 to control when water is released from the supply tank 75 to the sump 51. An overflow outlet 106 fluidly connecting the tank 75 to the tub 14 can be included in the supply tank 75. The supply tank 75 can be filled and drained and refilled repeatedly.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use. The supply tank 75 tank is further fluidly connected to the diverter valve 59 by a diverter supply line 101. The flow of liquid through diverter supply line 101 is controlled by a tank valve 102.

A water softener 78 is provided with the water supply system 70 to soften the fresh water. The water softener 78 is shown fluidly coupling a water supply conduit 73 to the supply tank 75 via controllable valve 77 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the diverter valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 110 is provided to filter un-dissolved solids from the liquid in the treating chamber 16. The filter system 110 includes a coarse filter 112 and a fine filter 114, which can be a removable basket 116 residing in the sump 51, with the coarse filter 112 being a screen 118 circumscribing the removable basket 116. Additionally, the recirculation system 50 can include a rotating filter in addition to or in place of the either or both of the coarse filter 112 and fine filter 114. Other filter arrangements are contemplated such as an ultra-filtration system.

Figure 3:
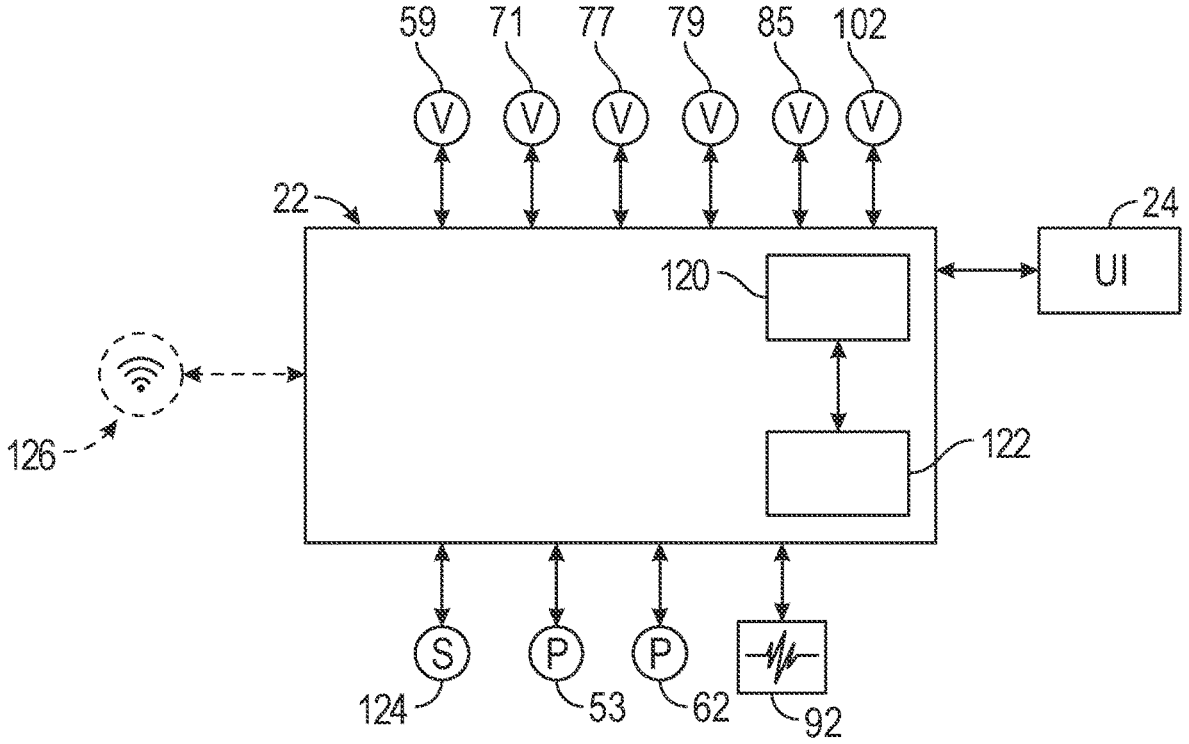
FIG. 3 is a schematic view of a controller of the dishwasher of FIG. 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 120 and a central processing unit (CPU) 122. The memory 120 can be used for storing control software that can be executed by the CPU 122 in completing a cycle of operation using the dishwasher 10 and any additional software. For example, the memory 120 can store one or more pre-programmed automatic cycles of operation that can be selected by a user and executed by the dishwasher 10. The controller 22 can also receive input from one or more sensors 124. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the diverter valve 59, the household water valve 71, the controllable valve 77, the return valve 79, the valve 85, and the tank valve 102. Optionally, the controller 22 can include or communicate with a wireless communication device 126.

Figure 4:
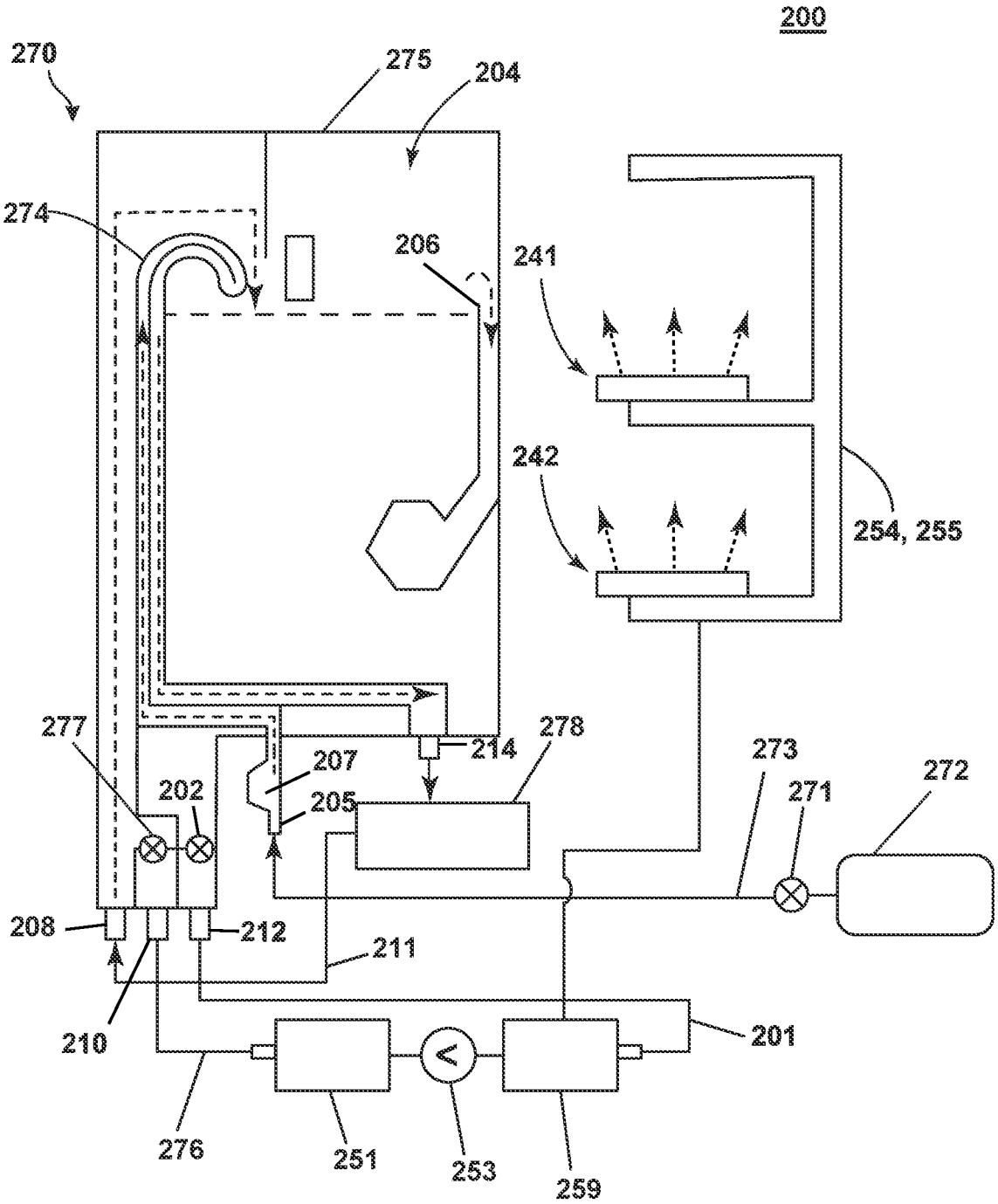
FIG. 4 is a simplified schematic view of a portion of the dishwasher of FIG. 2 illustrating an exemplary water flow path in accordance with various aspects described herein.

A plumbing arrangement 200 for dishwasher 10 according to an aspect of the disclosure herein is shown more specifically in FIG. 4. The plumbing arrangement 200 comprises a system 270 similar to the recirculation system 50 and water supply system 70; therefore, like parts will be identified with like numerals increased by 200, with it being understood that the description of the like parts of the systems 50, and water supply system 70 applies to the recirculation system 250 and water supply system 270, unless otherwise noted.

The plumbing arrangement 200 comprises a recirculation system 250 and a water supply system 270. In the water supply system 270, storage tank 275 comprises multiple fluid connections to different systems to provide multiple water and/or liquid flow paths that are useful in the operation and control of the dishwasher. For example, the storage tank 275 includes a storage chamber 204 fluidly accessible by at least two inlets, a fresh water inlet 205 a softened water inlet 208, and a diverter inlet/outlet 212. The storage tank 275 includes at least three outlets, a sump outlet 210, a softener outlet 214, and an overflow outlet 206 fluidly connecting the storage tank 275 to the tub 14, where it flows to the sump 51.

It should be noted as above that the storage tank 275, like the supply tank 75, can be used for both water supply and liquid re-use, like cooling tank 84. In other words, the storage tank 275 can be used as a refill tank for storing fresh water or it can be used as a reuse tank to store previously used water. Thus, storage tank 275 can hold either fresh water, including softened water, or reuse water that has been previously used in a phase of operation such as a rinse phase, or a mixture thereof, according to aspects disclosed herein.

While a variety of flow paths are contemplated for the storage tank 275, specific examples flow paths for the tank 275 are illustrated in FIGS. 4-7 where dashed lines and arrows indicate the specific water flow paths.

In one non-limiting example, as shown in FIG. 4, a fresh water supply path is illustrated. The water supply 272 feeds fresh water into the fresh water inlet 205, optionally through a flow meter 207, and into siphon break 274, where the water exits the storage tank at softener outlet 214 and flows into the water softener 278. From the water softener 278, the now softened water re-enters the storage tank 275 through a softened water inlet 208 and softened water supply line 211, where the softened water fills the storage chamber 204. In this way softened water is supplied to the storage tank 275.

The supply of softened water to the storage tank 275 can be terminated in a variety of ways, which are not limiting to this disclosure. For example, the volume of supplied softened water can be controlled by feedback from the flow meter 207 or it can be timed. The volume can be selected to terminate at or near the overflow outlet 206, which sets a corresponding overflow level. This volume of water can be thought of as a "charge" of water and can be selected to be commensurate with a volume required in one or more phases of a cycle of operation. This charge of water can be dispensed from the storage tank in different ways, including the supplying of more softened water to the storage tank 275, to overfill the tank 275, causing the softened water to flow to the tub 14 through the overflow outlet 206. In this manner, the storage tank 275 can be loaded with a charge of softened water prior to or during a cycle of operation and heat from a phase of the cycle of operation can be transferred to the charge of softened water in the storage tank. In a non-limiting example, the capacity of storage tank 275 is contemplated to be 2-4 liters.

While the siphon break 274 is shown inside the storage tank 275, it can be located exteriorly of the storage tank 275, and, in some implementations, it can be excluded, and the fresh water would just flow into the storage tank. Similarly, the water softener 278, in some implementations is optional, and flow would just go from the siphon break 274 into the storage chamber 204.

Figure 5:
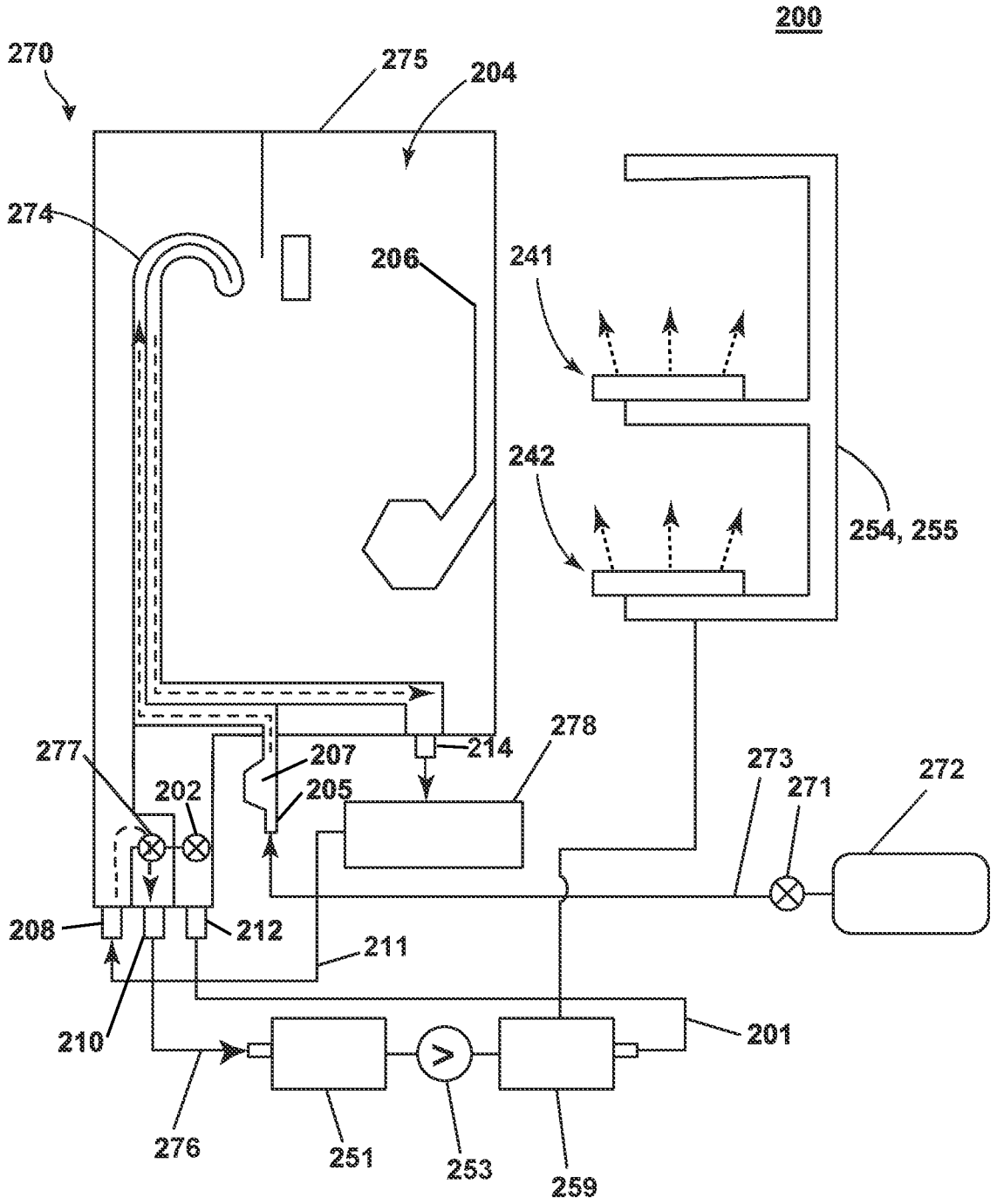
FIG. 5 is a schematic view of FIG. 4 and illustrating another exemplary water flow path.

Another flow path shown by the arrows in FIG. 5, which illustrates the supply of softened, fresh water directly to the sump 251, bypassing the storage chamber 204. In this non-limiting example, fresh water flows from the water supply 272 into siphon break 274 and to the softener 278. From the softener 278, water flows to water inlet 208. In this case, a valve 277 is open, which re-directs the softened water along supply line 276 to sump 251 before the softened water can fill the storage chamber 204. In other words, the valve 277 acts as a bypass valve to fluidly couple the softened water supply line to the sump. From the sump 251, the pump 253 can direct the softened water to the diverter valve 259, which selectively controls which of the sprayers 241, 242 receives the water from conduits 254, 255.

This flow path provides softened water to the sump 251 while bypassing the storage chamber 204 and/or the overflow outlet 206. This path can be used when it is desired not to hold the water in the storage tank, such as during an initial fill, and/or if the storage chamber 204 already contains a charge of water, and it is desired to leave that charge of water in the storage chamber 204. As with the prior example, the siphon break 274 and softener 278 can be optional.

Figure 6:
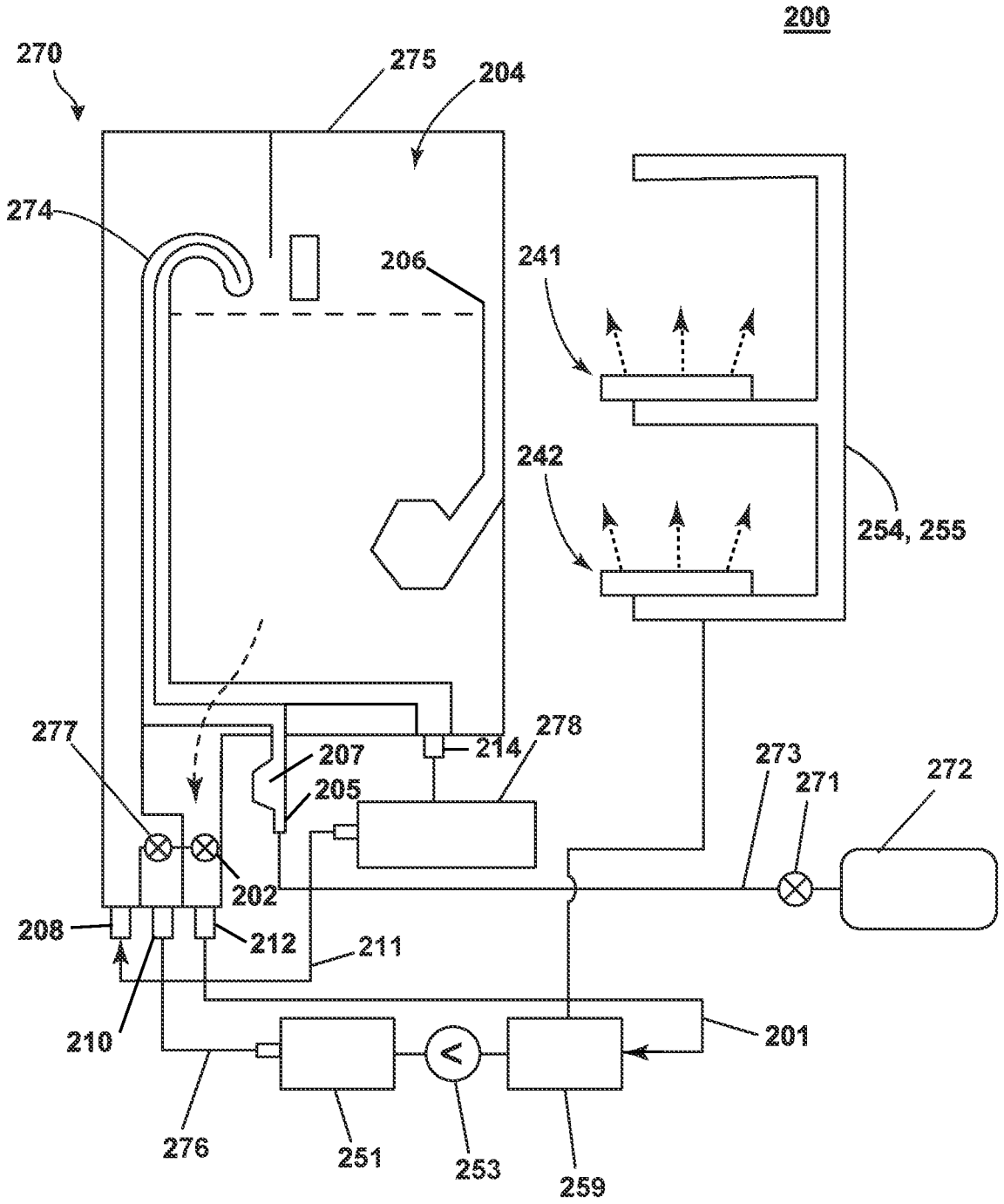
FIG. 6 is a schematic view of FIG. 4 and illustrating yet another exemplary water flow path in accordance with various aspects described herein.

Another flow path shown by the arrows in FIG. 6 illustrates the emptying of storage chamber 204 by opening tank valve 202. In this non-limiting example, water flows from the storage chamber 204 through diverter inlet/outlet 212 and through the diverter supply line 201 to the diverter valve 259. The diverter valve 259 can then be selectively moved between positions to control the flow of liquid through conduits 254, 255 to sprayers 241, 242. With this flow path, liquid in the storage chamber 204, be it water or re-use liquid, can bypass the sump 251 and the pump 253, and be supplied directly to the diverter valve 259. As with the prior example, the siphon break 274 and softener 278 can be optional.

Figure 7:
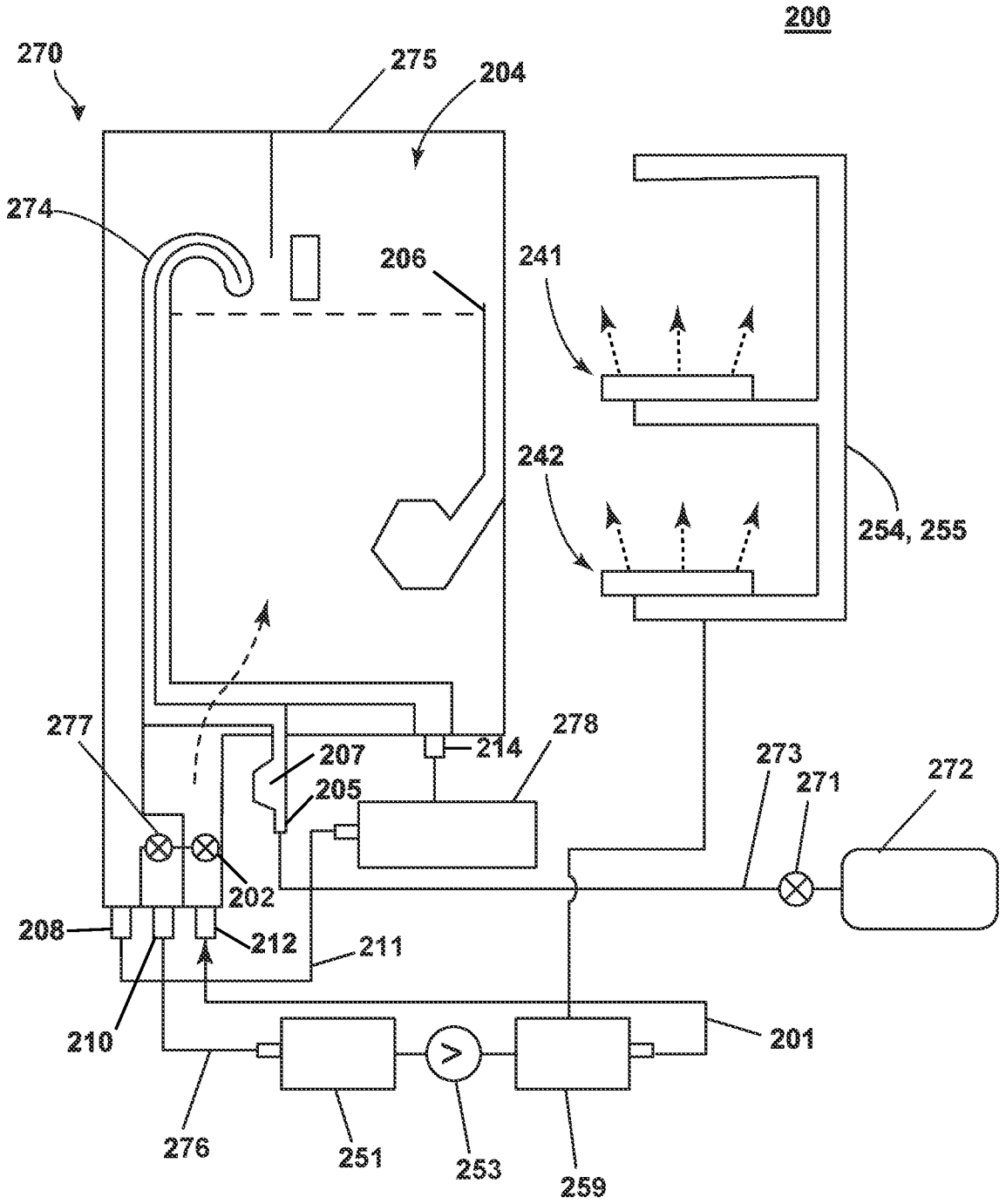
FIG. 7 is a schematic view of FIG. 4 and illustrating yet another exemplary water flow path in accordance with various aspects described herein.

Referring to FIG. 7, this flow path is bi-directional. In addition to the liquid flowing from the storage chamber 204 to the diverter valve 259, the liquid can flow from the diverter valve 259 to the storage chamber 204. Thus, this flow path can be used to supply liquid to the storage chamber 204, such as re-use liquid, by operation of the pump 253, if desired. In a non-limiting example, the storage chamber 204 can be partially filled during any phase in which the sprayers 241, 242 are in use. The diverter valve 259 has at least three positions for directing water flow and can therefore selectively direct water alternately between the sprayers 241, 242, and the storage tank 275. One non-limiting example of an application of the flow paths shown in FIGS. 6 and 7 is cleansing the storage chamber 204 by repeating fill-empty cycles alternately with fresh water and water containing cleaning aids. In another non-limiting example, the diverter valve 259 can be activated to direct water to the storage tank 275 in the event of standing water in the sump 51 that must be removed for any repair or maintenance procedures. In yet another non-limiting example the storage tank 275 can be used as a cooling tank 84 as described above.

The flow path can be used to effectively recirculate liquid in the storage chamber 204 by supplying liquid from the diverter 259 to the storage chamber 204, which, assuming there is a sufficient volume, can overflow into the overflow outlet 206, which flows back to sump, where it is picked up by the pump 253, and recirculated back to the storage chamber 204 through the diverter 259 and diverter supply line 201. Such a flow path could be used to mix re-use liquid with liquid in the storage chamber 204.

The plumbing arrangement 200 can be used for an automatic wash cycle of operation, which commonly includes, by way of non-limiting example, a wash phase, a rinse phase, and a drying phase. During the wash phase, a detergent/water mixture is recirculated and then drained. The automatic wash cycle can have multiple wash phases. The multiple wash phases can include a pre-wash phase where water, with or without detergent, is sprayed or recirculated on the dishes, and can include a dwell or soaking phase. There can be more than one pre-wash phases. A main wash phase, where water with detergent is recirculated on the dishes, follows the pre-wash phases. There can be more than one wash phase; the number of which can be sensor controlled based on the amount of sensed soils in the wash liquid. The wash phase is followed by a rinse phase where water alone or with a rinse agent is recirculated and then drained. There can be multiple rinse phases. One or more rinse phases will follow the wash phase(s), and, in some cases, come between wash phases. The number of rinse phases can also be sensor controlled based on the amount of sensed soils in the rinse liquid. The wash phases and rinse phases can include the heating of the water, even to the point of one or more of the phases being hot enough for long enough to sanitize the dishes. The water can be heated by an immersion heater in the sump or a heater integrated into the wash pump. A drying phase can follow the rinse phase(s). The drying phase can include a drip dry, heated dry, condensing dry, air dry, vented dry, fan-assisted dry, drying with a door opening system, or any combination of systems.

Figure 8:
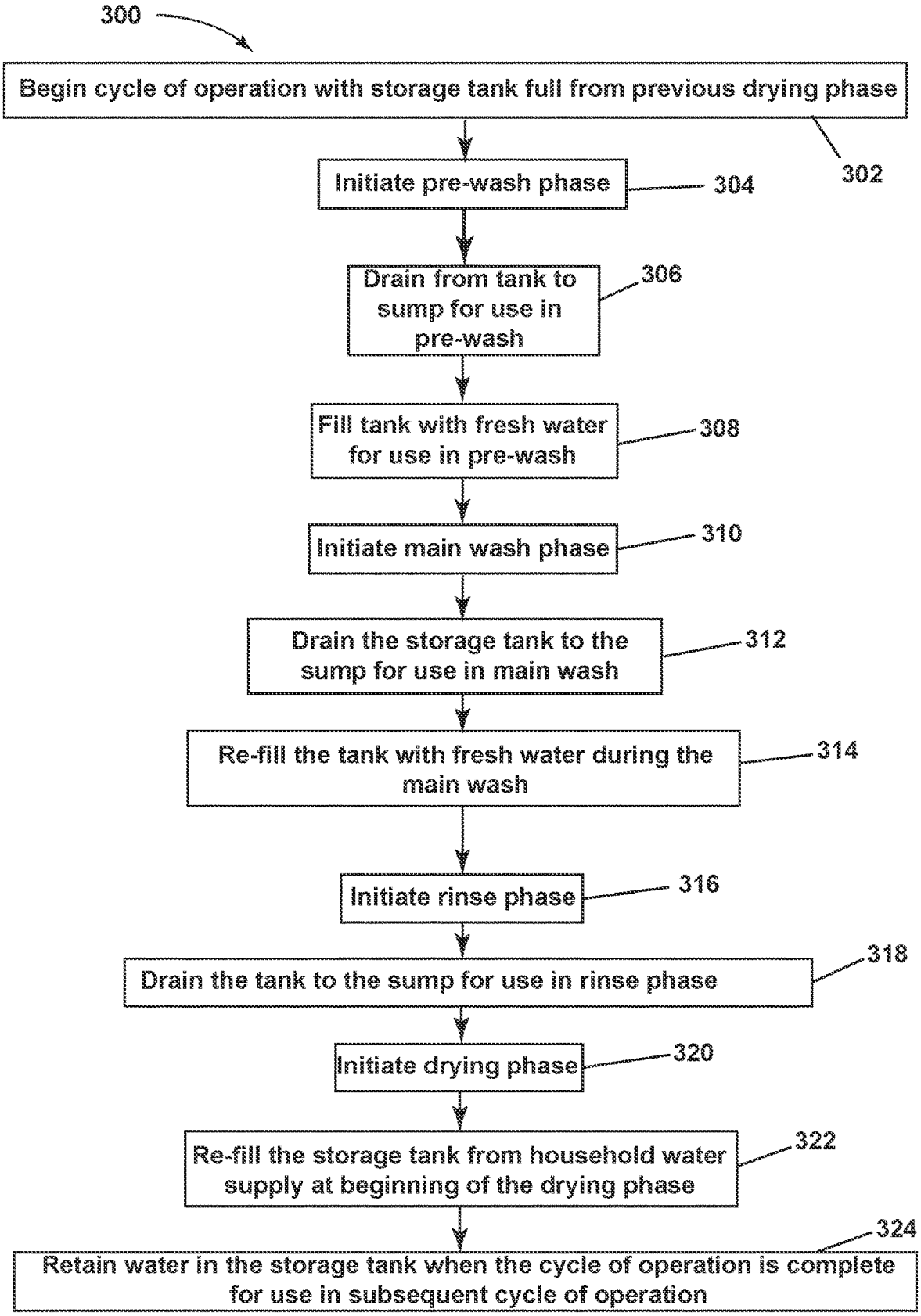
FIG. 8 is a flow chart showing the steps of an automatic cycle of operation of the dishwasher of FIG. 2 in accordance with various aspects described herein.

Referring now to FIG. 8, a method of using the plumbing arrangement 200 and dishwasher 10 in a cycle of operation 300 is illustrated. At step 302, the method can include initiating or beginning a cycle of operation. When a previous cycle of operation, and in particular a drying phase of said cycle of operation, has been completed, the storage tank 275 can be full such that the liquid, fresh water or reuse water, is retained in the storage tank 275 until the next cycle of operation. Therefore, when a cycle of operation is initiated at step 302, the storage tank 275 can contain a charge of liquid that is at or near ambient or room temperature, such as, by way of non-limiting example, in a range between 20° C. and 25° C., and further at about 24° C., since it has been retained within the storage tank 275 since the previous cycle of operation completed. Because liquid from the household water supply 272 is typically cool liquid supplied at, by way of non-limiting example, about 15° C., making use of the warmer liquid within the storage tank 275 can provide energy savings over using only the cooler water from the household water supply 272, which will require more energy to heat to the desired temperature.

At step 304, a pre-wash phase can be initiated, which begins with, at step 306, the liquid from the storage tank 275 is provided to the sump 251 by flowing from the storage tank 275 into the sump 251 by way of valve 277 and supply line 276. Additionally, and alternatively, the liquid can flow from the storage tank 275 to the sump 251 by way of valve 202, diverter supply line 201 and diverter valve 259 as shown in FIG. 6. During this step, the wash pump 253 is inactive. The pre-wash phase takes advantage of the slightly heated water that has been sitting at ambient temperature since the previous cycle of operation.

At step 308, the storage tank 275, currently empty, can be re-filled as shown in FIG. 4 with a charge of fresh water as part of the pre-wash phase. To fill the storage tank 275, water passes from the household supply line 273 to the storage tank 275, through the siphon break 274 and through the softener 278. The valve 277 then directs the water to fill the supply tank 275 as shown in FIG. 4. This filling step 308 can occur, in one non-limiting example, as soon as the storage tank 275 is drained, though the filling could also occur at any other point during the pre-wash phase. At the completion of the filling, the valve 277 closes, retaining the filled water within the storage tank 275. The step 308 can occur simultaneously with pre-washing of the dishes, wherein the water is directed by the diverter valve 259 from the sump 251 to the sprayers. Also during this pre-wash phase, water, with or without detergent, is sprayed or recirculated on the dishes. The pre-wash phase can include a dwell or soaking phase. There can be more than one pre-wash phase.

At step 310 the main wash phase is initiated and at step 312, the water in the storage tank 275 is once again drained to the sump 251 via the diverter valve 259 as shown in FIG. 6. The water in the sump 251 can be heated by heater 92, or by an integrated heater in the wash pump 253.

At step 314 the storage tank 275 is re-filled with fresh water, which can be cool liquid at about 15° C., according to the flow path illustrated in FIG. 4. The liquid being used within the treating chamber and the sump 251 for the main wash cycle is heated or is being heated to the main wash phase temperature of about 50° C. Valves 277 and 202 remain closed to retain the fresh water in the tank for the remaining duration of the main wash phase. It is contemplated that the arrangement of the storage tank 275 can be such that the storage tank 275 abuts at least a portion of tub 14 and is in thermal contact with the tub 14. Throughout the main wash phase, the cool liquid within the storage tank 275 can be heated, by way of non-limiting example, to about 20° C. or to an ambient temperature of about 24° C., by the thermal transfer through the tub from the heated water used in the main wash phase. At the end of the main wash phase, the liquid is drained from the tub 14 and the sump 251.

At step 316, rinse phase is initiated. Generally in this phase, water is sprayed over the articles to remove traces of wash liquid, treating chemistries from the previous cleaning phases, and any trace remaining soils. At step 318, the water in the storage tank 275 is drained to the sump 251 via the diverter valve 259. This water is warmer than fresh water due to retention in the storage tank 275 for at least a portion of the main wash phase. Thus the energy cost of heating the rinse water is reduced. During the final rinse phase, the rinse water is heated to high temperatures to assist in reduction of drying times.

At step 320 the drying phase is initiated which can involve fan-assisted drying, vented drying, door-opening systems or combinations thereof. During the drying phase, at step 322, the tank 75 is re-filled with a charge of rinse water that has accumulated in the sump 51 during the course of the rinse phase. The re-fill of storage tank 275 can be accomplished in this step according to the flow path shown in FIG. 7. The valves 277, 202 are closed such that at step 324 the rinse water is retained in the storage tank 275 for future use in a subsequent cycle of operation, thus decreasing the total amount of water used to complete a cycle of operation by approximately 2-4 L while the energy consumption can be decreased by approximately 50 W h.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to a cycle of operation, the dishwasher comprising:

a tub at least partially defining a treating chamber;

a sump fluidly connected to the tub;

at least a first sprayer and a second sprayer emitting liquid into the treating chamber;

a liquid recirculation circuit having a first branch fluidly coupled to the first sprayer and a second branch fluidly coupled to the second sprayer;

a diverter valve selectively fluidly coupling to the first branch or the second branch;

a recirculation wash pump arranged on a direct flow path between and fluidly coupling the sump and the diverter valve; and a water supply system comprising:

a tank defining an interior and having a diverter inlet/outlet through which a flowpath is bi-directional, with a first flow direction from the interior of the tank to the diverter valve and a second flow direction from the diverter valve to the interior of the tank, a household water supply conduit fluidly coupled to the interior of the tank, a sump supply line fluidly coupling the interior of the tank to the sump, a diverter supply line, separate from the sump supply line, the diverter supply line fluidly coupling the diverter inlet/outlet of the tank to the diverter valve in the first flow direction, wherein the diverter valve is configured to selectively supply liquid from the interior of the tank to at least one of the first sprayer or the second sprayer through at least one of the first branch or the second branch, bypassing the sump and the recirculation wash pump, and the recirculation wash pump operable to supply re-use liquid from the diverter valve into the interior of the tank, in the second flow direction, via the diverter supply line and the diverter inlet/outlet of the tank.

2. The dishwasher of claim 1 wherein the diverter valve is selectively moveable between a first position, where the recirculation wash pump is fluidly coupled to the first sprayer, a second position, where the recirculation wash pump is fluidly coupled to the second sprayer, and a third position, where the tank is fluidly coupled to the diverter valve.

3. The dishwasher of claim 1, further comprising a water softener fluidly coupled to the tank.

4. The dishwasher of claim 3 wherein the water softener is fluidly coupled downstream of the tank.

5. The dishwasher of claim 4 wherein the water softener is fluidly coupled upstream of the sump.

6. The dishwasher of claim 3 wherein the tank further comprises a siphon break fluidly coupling the household water supply conduit to the water softener.

7. The dishwasher of claim 6, further comprising a softened water supply line fluidly coupling the water softener back to the tank.

8. The dishwasher of claim 7, further comprising a bypass valve fluidly coupling the softened water supply line to the sump.

9. The dishwasher of claim 1 wherein the tank is both a refill tank and a reuse tank.

10. The dishwasher of claim 1 wherein at least a portion of the tank abuts a portion of the tub.

11. The dishwasher of claim 1 wherein the diverter supply line is bi-directional.

12. The dishwasher of claim 11 wherein the household water supply conduit is uni-directional.

13. The dishwasher of claim 12 wherein the sump supply line is uni-directional.

14. The dishwasher of claim 1, further comprising a first valve fluidly coupling the diverter supply line to the tank.

15. A method of operating the dishwasher of claim 1, comprising:

a pre-wash phase comprising supplying a charge of liquid from the tank through the diverter valve to the sump and recharging the tank with fresh water from a household water supply;

a main wash phase, following the pre-wash phase, comprising supplying a second charge of liquid from the tank, through the diverter valve, to the sump and recharging the tank with fresh water from the household water supply;

a rinse phase, following the main wash phase, comprising supplying a charge of liquid from the tank, through the diverter valve, to the sump to form a charge of rinse liquid;

a drying phase, following the rinse phase, comprising reducing the humidity within the treating chamber of the dishwasher; and supplying the charge of rinse liquid to the tank through the diverter valve.

16. The method of claim 15 wherein the charge of rinse liquid is supplied to the tank at the end of the rinse phase or the beginning of the drying phase.

17. The method of claim 15 wherein the rinse phase is a final rinse phase.

18. The method of claim 15 wherein the charge of liquid supplied from the tank during the pre-wash phase is not heated.

19. The method of claim 15 wherein at least one of the second charge of liquid supplied from the tank during the main wash phase or the charge of liquid supplied from the tank during the rinse phase is heated.

20. A dishwasher for treating dishes according to a cycle of operation, the dishwasher comprising:

a tub at least partially defining a treating chamber;

a sump fluidly connected to the tub;

at least a first sprayer and a second sprayer emitting liquid into the treating chamber;

a liquid recirculation circuit having a first branch fluidly coupled to the first sprayer and a second branch fluidly coupled to the second sprayer;

a diverter valve selectively fluidly coupling to the first branch or the second branch;

a recirculation wash pump arranged on a direct flow path between and fluidly coupling the sump and the diverter valve; and a water supply system comprising:

a tank defining a tank interior forming a tank chamber that is fluidly accessible by at least a diverter inlet/outlet, a household water supply conduit fluidly coupled to the tank interior, a sump supply line fluidly coupling the tank interior to the sump, a diverter supply line, different and separate from the sump supply line, the diverter supply line fluidly coupling the tank interior via the diverter inlet/outlet of the tank to the diverter valve in a first flow direction from the tank interior to the diverter valve, bypassing the sump and the recirculation wash pump, a tank valve selectively fluidly coupling the diverter supply line to the tank interior and configured to control a flow of liquid through the diverter supply line by selectively allowing or preventing the flow of liquid through the diverter inlet/outlet, and the recirculation wash pump operable to supply re-use liquid from the diverter valve into the tank interior in a second flow direction from the diverter valve to the tank interior, the second flow direction opposite the first flow direction, via the diverter supply line and the diverter inlet/outlet of the tank;

wherein the tank interior is configured to be filled with both fresh water from the household water supply conduit and filled with re-use liquid within a single cycle of operation.

* * * * *